United States Patent [19]

Irish

[11] Patent Number: 4,961,119

[45] Date of Patent: Oct. 2, 1990

[54] HARMONIC OPTICAL OSCILLATOR

[76] Inventor: Ernest E. Irish, 4019 Tacoma Ave., Las Vegas, Nev. 89121

[21] Appl. No.: 110,923

[22] Filed: Oct. 19, 1987

Related U.S. Application Data

[63] Continuation-in-part of Ser. No. 866,251, May 23, 1986, abandoned.

[51] Int. Cl.[5] ..... G04F 8/00; G04F 5/00

[52] U.S. Cl. ..... 368/156; 368/118; 331/94.1

[58] Field of Search ..... 368/156, 118–121, 368/10, 155; 372/32, 22

[56] References Cited

U.S. PATENT DOCUMENTS 4,286,838 9/1981 Huignard ..... 350/96

4,482,259 11/1984 Facklam ..... 368/156

*Primary Examiner*—Bernard Roskoski

[57] ABSTRACT

The Harmonic Optical Oscillator is a solid state clock on a microchip. Two solid state lasers of nearly identical frequency transmit beams into an optical waveguide. The two beams interfere with each other causing a modulation of the light amplitude in the waveguide. A light detector picks up the harmonic beat. Accuracy of at least ½ second a year (approximately 200 times better than today's quartz microchips) is expected.

11 Claims, 1 Drawing Sheet

HARMONIC OPTICAL OSCILLATOR

This application is a continuation-in-part of application Ser. No. 866,251, filed May 23, 1986, entitled Photonic Oscillator, now abandoned.

BACKGROUND OF THE INVENTION

In the twentieth century time and frequency standards have been revolutionized by oscillators, defined by the electronics industry as a circuit that converts direct-current power into alternating or pulsed current power at a frequency usually greater than can be achieved by rotating electromechanical alternating-current generators. Any timing device that produces pulsed current from direct current is referred to by the industry as an oscillator regardless of the method of conversion, such as electrical, piezoelectric, or atomic resonance beam. The quartz oscillator was the world's most accurate clock in the 1930s and 1940s. It suffers, however, from age and temperature dependent frequency drift. In the 1950s and 1960s there were quantum leaps in performance as atomic beams were used to stabilize the drift of quartz oscillators.

In the 1970s quartz oscillators benefited in size, weight, power consumption, price, reliability, and durability by being incorporated onto microchips.

However, since their piezoelectric properties are bulk phenomena, quartz chips still suffer from age and temperature dependent drift. There has remained a wide gap between the practicality of quartz chips and the performance of atomic clocks.

Atomic oscillators still retain the drawbacks of bulky component construction resulting in high price (up to $40,000), high weight, large size, large power requirements, and low durability. Atomic clocks, such as that shown in Ezekiel et al Pat. No. 4,315,224 of Feb. 9, 1982, use a vapor producing oven inside a vacuum tube (implied but not shown in the drawing) to produce a stream of gaseous atoms. One laser pumps the gas, a second laser is locked to an absorption resonance, and the frequency difference of the beams is the resonance frequency of the gas. That frequency is restricted to microwave frequencies under 100 megahertz. Such clocks cannot operate in a solid state (without the vacuum tube and gas stream), or run without performance limiting feedback loops, or operate above the low frequency resonance of the gas.

Until this invention there was no method for putting a timing circuit on a microchip that utilized discrete quantum transitions. This invention allows the use of a quantum oscillator on a microchip, bringing the two ends of the spectrum (practicality and performance) together into one machine.

Until this invention no optical oscillator has been successfully produced. Anticipation of the harmonic optical oscillator is nonexistent since prior art contains no references at all to any optical oscillator.

Some laser gyroscope components have been put on microchips but these are unable to function as time or frequency standards. Optical gyroscopes generate a single beam which is split in two and sent in opposite directions through a closed loop. Rotation of the loop changes the relative path lengths, causing phase shifts. The harmonic optical oscillator generates two beams of different frequencies, then combines them so that they travel on a single path in the same direction without closed loops. Gyroscopes cannot measure time and oscillators cannot measure distances. Therefore, the optical gyroscpe and the optical oscillator remain as distinct from each other as a range finder and a pendulum. Any attempts to make an optical oscillator from a single beam would result in a signal so fast that the individual oscillations could not be discerned

SUMMARY OF THE INVENTION

On a microchip there are two semiconductor lasers driven off the same electrical circuit. The two lasers emit continuous wave radiation in the low infrared at slightly different frequencies. The two beams are coupled to a monomode optical waveguide. As the two beams travel together down the waveguide they interfere with each other. Constructive and destructive interference results in amplitude modulation of the combined beam (beating). The beat frequency is low enough to be read in real time. The intensity modulated light flux is picked up by a photodiode light detector. Its output (the clock signal) is the beating of two coherent light sources. The detector output may be processed or transmitted as desired.

DETAILED DESCRIPTION

Figure 1:
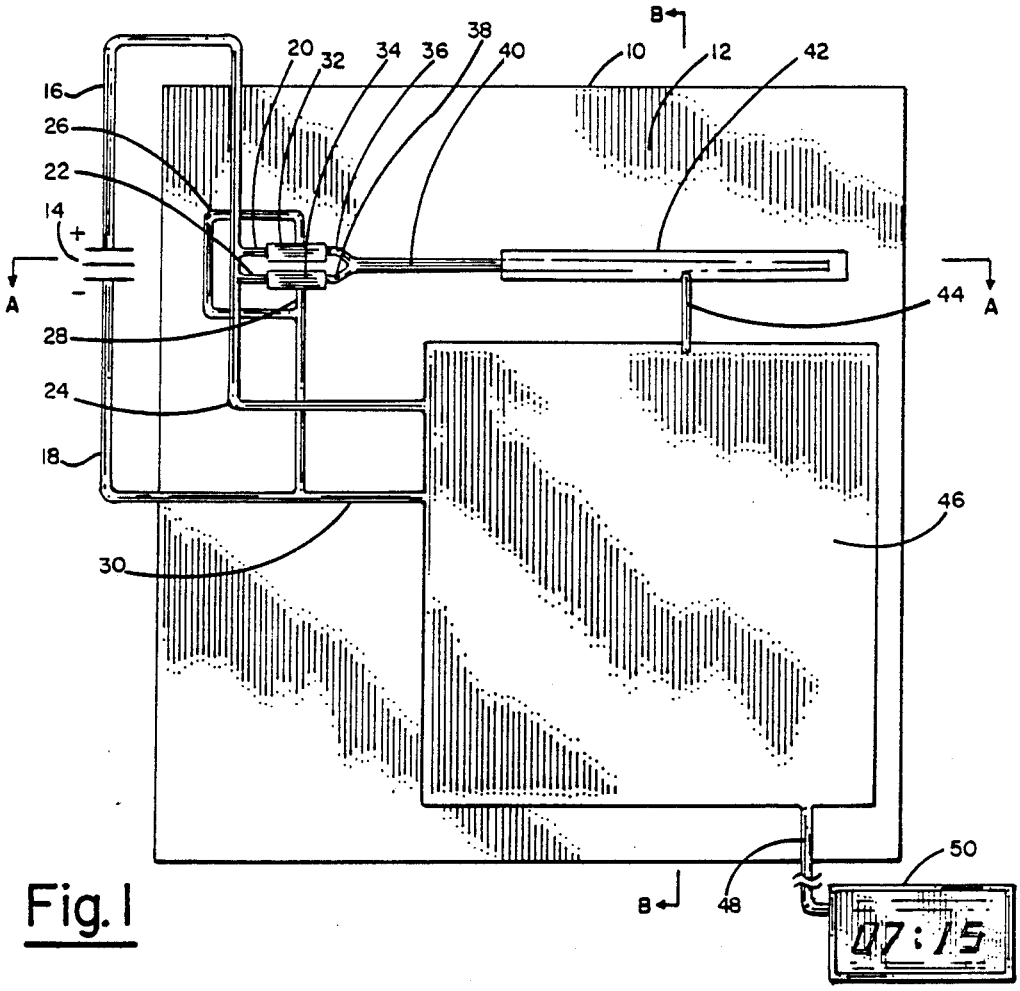
FIG. 1 is a top view of the invention.

The invention is a new type of clock utilizing a novel process for keeping time. The clock shown in FIG. 1 is built on a microchip 10. The chip is five millimeters on a side with the parts laid into the Silicon surface 12 by the standard techniques of etching and deposition. One volt of electric current is fed from an external power source 14 into the chip through an electrical input wire 16. Ten milliamps of power are fed into each of the two lasers 32 and 34 through the individual laser electrical inputs 20 and 22. Individual laser electrical returns 26 and 28 are required to maintain a continuous electrical circuit path. All electrical return lines converge on the external electrical return wire 18. In the preferred embodiment cleave-coupled-cavity lasers are used to ensure the monomode frequency stability required. The lasers are made of GaAs, $GaAs_{1-x}P$, or $GaAl_{1-x}As$ material. They operate at one volt. The individual lasers in their commercial form are typically 400 microns in length, 70 microns in width, and 5 microns thick. Laser output is 3 milliwatts for each laser. Laser-1 32 has a wavelength of 30.00 micrometers (far infrared) and a frequency of $1.000\times10^{13}$ Hertz. Laser-II 34 has a wavelength of 30.12 micrometers (far infrared) and a frequency of $9.960\times10^{12}$ Hertz. The lasers differ in frequency by one part in 250. Frequency stability of one part in 40 billion ($2.5\times10^{-11}$) is expected from the lasers.

Any pair of coherent light sources may be used, provided they are held to sub-micron tolerances of relative motion. This eliminates bulky, discrete component construction as an alternative for a practical machine because the parts could not be held steady enough in relation to each other. With all the essential parts laid out on a single microchip the stability of parts relative to each other is no longer a problem. An alternative construction may be made with distributed-feedback lasers instead of cleave-coupled-cavity lasers. Few other laser designs could provide the monomode frequency stability required for an accurate system. A second alternative would be to use a single laser, splitting the beam and passing one part through a phase shifter. A third alternative would be to use a single dual frequency mode laser producing two simultaneous continuous-wave frequencies. The clock could be produced with three or more lasers but that would be a counter productive proliferation of parts. Current progress in solid state lasers, such as reflective coatings, may reduce power requirements by one or two orders of magnitude.

The lasers are coupled to an optic waveguide by waveguide couples 36 and 38. In the preferred embodiment the waveguide 40 is 3½ millimeters in length, of buried channel construction, laid within the trench 43, and has cross-sectional dimensions of about two microns. Materials may be silica, GaAs, or poly(cyclohexylmethacrylate)(PCHMA). The two beams interfere constructively and destructively forming a harmonic beat within the waveguide. The frequency of the beat is the frequency difference between the two beams. In a practical machine this frequency will be above 100 megahertz. In the preferred embodiment the rate of beating is 40 gigahertz, which constitutes the clock rate. The amplitude modulation is fully developed at ¼ of a harmonic wavelength or 2 millimeters for the preferred embodiment. The waveguide is just long enough to put the 2 mm point in the center of the photodiode light detector. If different wavelengths giving a higher or lower clock rate are desired a shorter or longer waveguide may be used. The waveguide may be curved to shorten the overall length of the waveguide while maintaining path length. It must be laid out in an open path without closed loops.

Figure 2:
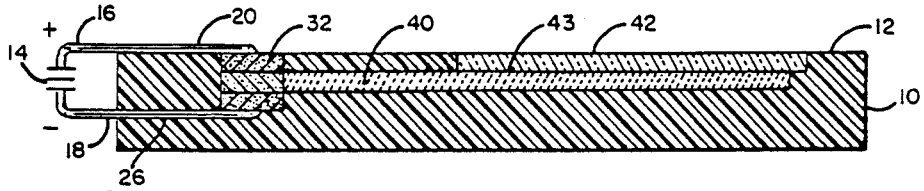
FIG. 2 is a side view cutaway showing the long axis of one laser, the waveguide and the light detector. This is shown as plane A in FIG. 1.

A light detector 42 picks up the sinusoidal amplitude modulation of the light level in the waveguide. A transverse, waveguide coupled, photodiode is the preferred detector because of its high speed and high efficiency. To approach one hundred percent efficiency it is 3 millimeters long. The photodiode is made of GaAs with Silicon doping or GaAs with Germanium doping. The photodiode absorbs the entire light flux developing five to six milliamps of electric current which exits the detector through the photodiode output signal line 44. FIG. 2 shows the relationships between a laser, the waveguide, and the light detector (plane A in FIG. 1).

Figure 3:
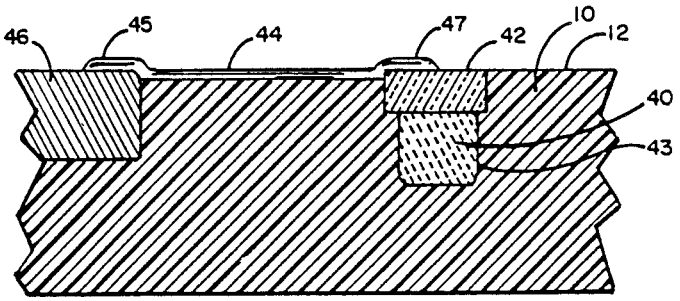
FIG. 3 is a side view cutaway perpendicular to FIG. 2 showing the waveguide, light detector, and rate reducing processor. This is shown as plane B in FIG. 1.

The signal output then goes to a rate reducing processor 46. The processor is powered by the processor electrical input 24. The processor electrical return line 30 is required to maintain a continuous electrical circuit path. FIG. 3 shows the relationships between the waveguide, the light detector, and the processor (plane B in FIG. 1).

Direct digital frequency synthesis is a desirable method of processing since it allows the multiplexing of many extremely stable, pure frequencies at small intervals over a large bandwidth, using a minimum of components. Digital synthesis requires the oscillator to have a higher frequency than the synthesized frequency. The 40 gigahertz oscillator frequency allows the digital synthesis method to be applied to the generation of frequencies a thousand fold higher than with present atomic clocks, giving a thousand fold greater bandwidth to this versatile technique.

An alternative would be to feed the clock rate signal directly out of the chip for external processing. A second alternative would be the use of frequency multipliers to provide output frequencies higher than the clock rate signal. A third alternative would be the use of frequency dividers to provide output frequencies lower than the clock rate signal.

In the preferred embodiment (which is intended for domestic use) the electrical pulses emerging from the detector are sent to an accumulator which advances the second display once in 40 billion pulses. The first stage is a GaAs set level transistor that passes the signal crests as a steady series of sharp, discrete pulses. A pulse counter comprising dual GaAs flipflops divides the number of pulses by four. The 10 gigahertz signal is then sent to a ring counter comprising 10 divide by 10 registers. Silicon may be used at this stage.

After processing, the time signal leaves the chip through the chip output wire 48 and may be used to drive a display 50 or to switch computer circuitry.

The lasers are resistant to temperature variations and vibration. Also, the clock rate is extremely high. These factors contribute to an inherently high stability and accuracy. The minimum accuracy of the system may be determined mathematically as shown below.

The accuracy of the system is calculated by doubling the frequency drift of the lasers and then multiplying it by 250. The doubling is necessary because there are two lasers and the multiplication is the result of the harmonic beat increasing the wavelength 250 fold thereby magnifying the error by that factor. These calculations are shown below:

Definitions $\nu$ ≡ frequency c ≡ speed of light ($3 \times 10^8$ meters/sec) $\nu = c/\lambda$ $\lambda$ ≡ wavelength $\Delta$ ≡ change in (followed by variable)

Given Quantities

Seconds per year = $3.2 \times 10^7$

Laser frequency = $f = 1 \times 10^{13}$ Hertz

Laser frequency drift ($\Delta f$) = 1 part in 40 billion $= 2.5 \times 10^{-11}$ Laser wavelength = $\lambda = 3 \times 10^{-5}$ meters Desired clock rate (Harmonic beat rate) = 40 gHz $= 4.0 \times 10^{10}$ Hz Calculated Quantities 1. $$\text{beat ratio} = \frac{\nu(\text{laser})}{\text{clock rate}} = \frac{1 \times 10^{13}}{4 \times 10^{10}} = 250$$

2. $$\text{wavelength separation of lasers} = \Delta\lambda = \frac{\lambda(\text{Laser})}{\text{beat ratio}}$$

$$= \frac{3 \times 10^{-5}\ \text{m}}{250} = 1.2 \times 10^{-7}\ \text{m}$$

= 120 nanometers separation

[2 nanometers minimum separation (resolution) is required]

3. $\Delta f$ (laser I) + $\Delta f$ (laser II) = $5 \times 10^{-11}$ $(\Delta f_1 + \Delta f_2)$(beat ratio) = $(5 \times 10^{-11})(250)$ $= 1.25 \times 10^{-8}$ clock error (sec/year)(clock error) = sec error/year $(3.2 \times 10^7)(1.25 \times 10^{-8}) = 0.4$ sec error/year Accuracy of better than ½ sec/year is expected. This is about 200 times more accurate than today's quartz microchips.

Though the preferred embodiment operates at 40 gigahertz, higher or lower clock rates may be chosen. Rates higher than 40 gHz will give higher accuracies; however, much higher rates would require cryrogenic circuitry. Lower clock rates may be chosen but this would lead to reduced accuracy. The limiting factor in clock rates is the ability of the detector and processor to respond to the signal in real time.

Laser wavelengths are then selected to achieve the required rate drop while maintaining the lowest frequencies within their operating ranges.

It is apparent that this technology may be applied at any frequencies where solid state lasers and optical waveguiding apply. An extension of this technique into the visible or ultraviolet regions is within the scope of the principals outlined here.

The disclosure reveals the preferred embodiment of the invention. However, variations in the form, construction and arrangement of components and the modified application of the invention are possible without departing from the spirit and scope of the claims.

I claim:

1. A time and frequency standard comprising a microchip base, a first semiconductor laser means integrated on the base producing a first coherent infrared beam, a second semiconductor laser means integrated on the base producing a second coherent infrared beam, said first and second beams having a wavelength difference of at least 2 nanometers, an optic waveguide means integrated on the base laid out in an open path for converging said first beam and said second beam into a single beam, a light detecting means integrated on the base for detecting the light modulation in the said single beam resulting from the interference produced by the convergence of the first and second beam, the light detecting means producing an electrical signal at a fixed clock rate, and a processing means integrated on the base for converting said clock rate signal to a desired output time and frequency signal, said optic waveguide means being completely integrated on the microchip base and extending between both the first and second semiconductor laser means and the light detecting means.

2. The time and frequency standard of claim 1 having first and second cleave-coupled-cavity lasers integrated on the base as the first and second laser generating means.

3. The time and frequency standard of claim 1 having distributed-feedback lasers integrated on the base as the first and second laser generating means.

4. The time and frequency standard of claim 1 having a cleave-coupled-cavity laser integrated on the base as the first laser generating means and a frequency shifted portion of the first beam as the second laser generating means.

5. The time and frequency standard of claim 1 having a distributed-feedback laser integrated on the base as the first laser generating means and a frequency shifted portion of the first beam as the second laser generating means.

6. The time and frequency standard of claim 1 having a single dual frequency mode laser integrated on the base, producing a continuous beam of two simultaneous frequencies, as the first and second laser generating means.

7. The time and frequency standard of claim 1 having n lasers integrated on the base as the laser generating means, where n is greater than two.

8. The time and frequency standard of claims 1,2,3,4,5,6, or 7 having the clock rate signal feed directly out of the chip for external processing.

9. The time and frequency standard of claims 1,2,3,4,5,6, or 7 having direct digital frequency synthesizer integrated on the base as the processing means.

10. The time and frequency standard of claims 1,2,3,4,5,6, or 7 having a frequency divider as the processing means, producing an output signal higher than the clock rate signal.

11. The time and frequency standard of claims 1,2,3,4,5,6, or 9 having a frequency multiplier as the processing means, producing an output signal higher than the clock rate signal.

* * * * *